US010598173B2

(12) United States Patent
Lettini

(10) Patent No.: US 10,598,173 B2
(45) Date of Patent: Mar. 24, 2020

(54) VARIABLE DISPLACEMENT PUMP AND A METHOD FOR REGULATING THE PUMP

(71) Applicant: CASAPPA S.P.A., Collecchio (Parma) (IT)

(72) Inventor: Antonio Lettini, Parma (IT)

(73) Assignee: CASAPPA S.P.A., Collecchio (IT)

( * ) Notice: Subject to any disclaimer, the term of this patent is extended or adjusted under 35 U.S.C. 154(b) by 184 days.

(21) Appl. No.: 15/575,510

(22) PCT Filed: Jun. 17, 2016

(86) PCT No.: PCT/IB2016/053606

§ 371 (c)(1),
(2) Date: Nov. 20, 2017

(87) PCT Pub. No.: WO2016/207768

PCT Pub. Date: Dec. 29, 2016

(65) Prior Publication Data

US 2018/0149150 A1 May 31, 2018

(30) Foreign Application Priority Data

Jun. 26, 2015 (IT) ..... 102015000027873

(51) Int. Cl.
*F04B 49/00* (2006.01)
*F04B 1/2078* (2020.01)
(Continued)

(52) U.S. Cl.
CPC ..... *F04B 49/002* (2013.01); *F04B 1/2078* (2013.01); *F04B 1/324* (2013.01); *F04B 49/06* (2013.01); *F04B 49/125* (2013.01)

(58) Field of Classification Search
CPC .. F04B 1/29–324; F04B 1/328; F04B 1/0694; F04B 1/2078; F04B 49/002; F04B 49/125; F01C 20/185
See application file for complete search history.

(56) References Cited

U.S. PATENT DOCUMENTS 5,226,349 A * 7/1993 Alme ..... F04B 1/324 91/506
5,881,629 A 3/1999 Gollner et al.
(Continued)

FOREIGN PATENT DOCUMENTS

CN 201363244 12/2009
CN 104454422 3/2015
(Continued)

*Primary Examiner* — Kenneth J Hansen
(74) *Attorney, Agent, or Firm* — Pearne & Gordon LLP

(57) ABSTRACT

A variable displacement pump comprising a pumping piston (10), cylinder head (2); a rotating shaft (3); regulating means (4) of the displacement of the pump, said means in turn comprising: a structure (41) having a variable inclination; a fluid-dynamic actuator (42) for regulating an inclination of said structure (41); command means (43) for the actuator (42), which assume a non-equilibrium and an equilibrium position, said command means (43) in turn comprising: a sliding body (431) being able to take at least a first position in which it places a chamber (420) acting on said actuator (42) in communication with a first zone (51) at least initially having a pressure that is different from a pressure present in said chamber (420); a sliding element (432) with respect to the sliding body (431) for resetting said equilibrium configuration, said sliding element (432) being distinct from said actuator (42) and being mechanically actuated in consequence of a variation of an inclination of said structure (41).

9 Claims, 7 Drawing Sheets

(51) Int. Cl.

| | |
|---|---|
| ***F04B 1/324*** | (2020.01) |
| ***F04B 49/06*** | (2006.01) |
| ***F04B 49/12*** | (2006.01) |

(56) References Cited

U.S. PATENT DOCUMENTS

| | | | | |
|---|---|---|---|---|
| 6,283,721 | B1 | 9/2001 | Gollner | |
| 6,725,658 | B1 | 4/2004 | Lemmen et al. | |
| 2015/0050165 | A1* | 2/2015 | Zavadinka ..... | F04B 1/324<br>417/270 |

FOREIGN PATENT DOCUMENTS

| | | | |
|---|---|---|---|
| DE | 19653165 | C1 | 4/1998 |
| DE | 19842029 | A1 | 3/2000 |
| JP | 2013087690 | A | 5/2013 |

* cited by examiner

VARIABLE DISPLACEMENT PUMP AND A METHOD FOR REGULATING THE PUMP

TECHNICAL FIELD

The present invention relates to a variable displacement pump and a method for regulating it.

Variable displacement pumps enable regulating the flow rate of the operating fluid, optimising it as a function of the pressure of use, the movement velocity requested by the user or the available power.

This produces an energy saving. In fact if the pump had a fixed displacement in its functioning range, the flow rate would be such as to guarantee a correct functioning even when a high movement velocity is demanded, but that would determine an excess of flow rate when a lower movement velocity is demanded, and therefore in the operating mode a part of the flow rate developed by the pump would be wasted.

Further, the use of a variable displacement pump enables a greater flexibility of use. In fact, given an equal power absorption by the activating motor, the variable displacement pump enables reaching, at a low flow rate, greater pressure or, vice versa, higher flow rates at low pressures, and therefore having a broader range of use.

State of the Art

Pumps of the types described in documents U.S. Pat. Nos. 6,725,658 and 5,881,629 are known. These documents disclose axial piston pumps with oscillating plates, in which adjusting the inclination of the plate enables regulating the pump displacement. To adjust the inclination of the plate there is a cursor which moves internally of a body that is activated by an electrical supply. In the solution described in document U.S. Pat. No. 6,725,658, as a function of the position of the cursor the pusher member acting on the plate finds an equilibrium position as a function of the pressures imposed by the system and the elastic force of a spring interposed between the cursor and the pusher member.

A drawback of this constructional solution is connected to the fact that the search for an equilibrium position is conditioned by the presence of a spring that makes the response slow and subject to oscillations.

In the solution described in document U.S. Pat. No. 5,881,629, as a function of the position of the cursor the pusher member acting on the plate finds an equilibrium position in accordance with the pressures and the regulating pressure of an electro-hydraulic device, said regulating pressure being proportional to an electrical command signal. The electrical command signal is regulated by a microcontroller as a function of the value of the angular position of the plate detected by a sensor.

A drawback of said construction solution is the cost linked to the presence of the sensor. A further drawback is linked to the need to use a pressure regulating valve and a sensor for control of the displacement in a closed loop, and therefore subject to a compromise between velocity of response and oscillations.

Object of the Invention

In this context, the technical task that is the basis of the present invention is to disclose a method for regulating the pump displacement which obviates the drawbacks of the cited prior art.

In particular, the object of the present invention is to provide a pump and a method for regulating the displacement of the pump that improves the stability of the regulation thereof and the velocity of response of the pump. The specified technical task and the specified objects are substantially attained by a pump and a regulating method of the pump displacement comprising the technical characteristics set down in one or more of the accompanying claims.

BRIEF DESCRIPTION OF THE DRAWINGS

Further characteristics and advantages of the present invention will more fully emerge from the non-limiting description of a preferred but not exclusive embodiment of a pump and a method for regulating a displacement thereof, as illustrated in the accompanying drawings, in which.

DETAILED DESCRIPTION OF PREFERRED EMBODIMENTS OF THE INVENTION

Figure 1:
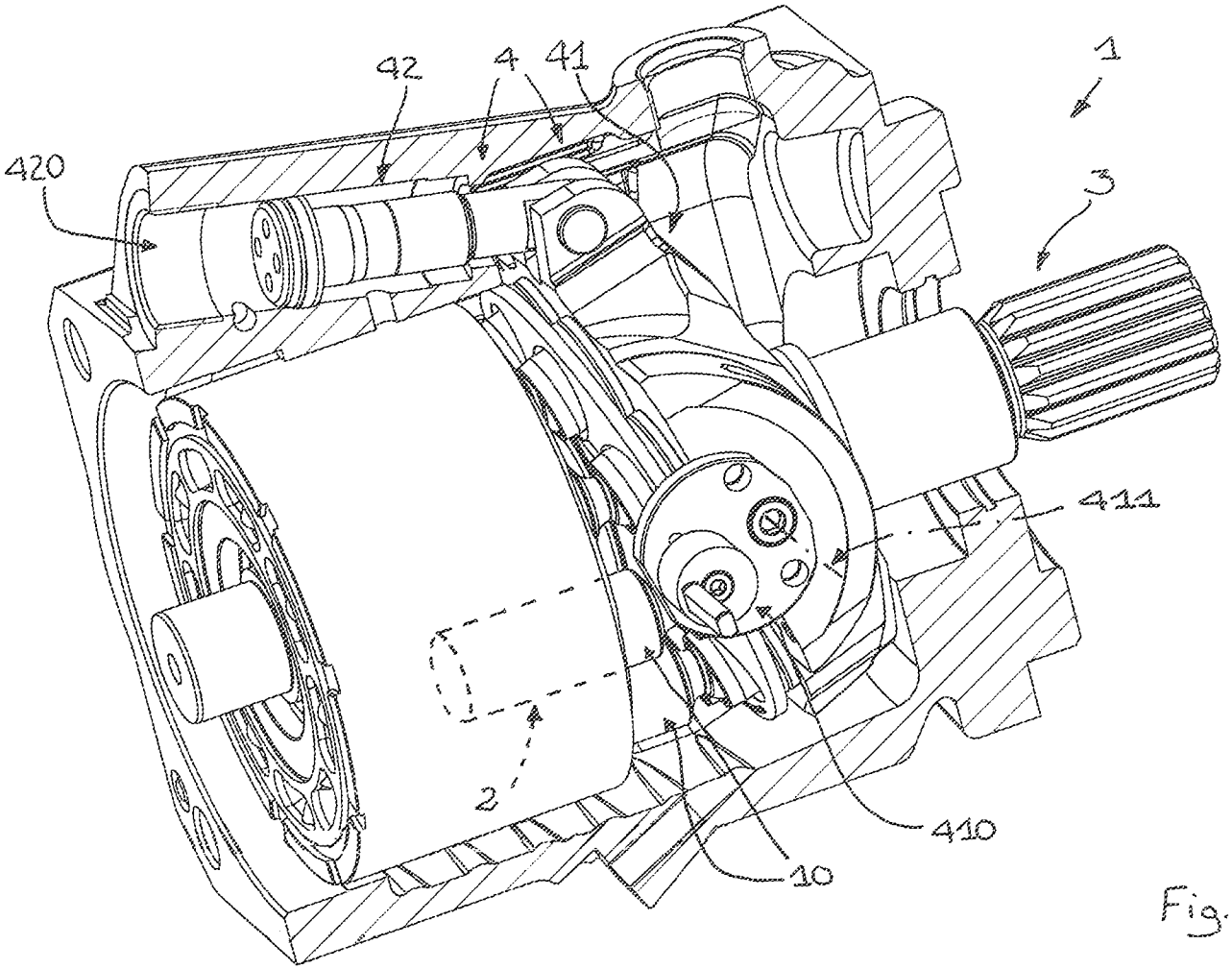
FIG. 1 is view of the pump with some parts section better to evidence others.

In the figures, reference numeral 1 denotes a variable displacement pump in its entirety. The pump 1 is of known type and is an oscillating plate type pump.

The pump 1 comprises:

i) a pumping piston 10 of a fluid to be treated;

ii) a sliding seating 2 (represented by a broken line in FIG. 1) along which the travel of the piston 1 takes place.

iii) a rotating shaft 3 which draws said piston 10 and said seating 2 in rotation.

A rotation of said shaft 3, at least in an operating configuration, corresponds to a sliding of the piston 10 along the seating 2. For the sake of completeness, it is specified that with nil flow rate (a non-operative configuration), a rotation of the shaft 3 does not correspond to a sliding of the piston 10 along the seating 2.

In the preferred embodiment the pump 1 comprises a plurality of pumping pistons 10 each housed in a corresponding seating 2. In this case the rotation of the shaft 3 draws each piston 10 and the corresponding seating 2. The seatings 2 of the pistons identify corresponding movement directions of the corresponding pistons 10; the directions being parallel to one another. The seatings 2 are one flanked to the other along an imaginary line closed upon itself (typically in a circle). A rotation of said shaft 3, at least in an operating configuration, (in which case the displacement and therefore the flow is not nil) corresponds to a sliding of the piston 10 along the corresponding seating 2.

The pump also comprises regulating means 4 of the displacement of the pump 1 as a function of an electrical signal.

The regulating means 4 in turn comprise a structure 41 having a variable inclination for regulating a length of a travel of the pumping piston 10 and therefore of the displacement of the pump 1; the variable-inclination structure 41 constrains an end of the piston 10. In technical jargon the variable-inclination structure 41 is also known as an "oscillating plate" structure (though the geometry is more complex than that of a plate). Pumps of this type are well known in the sector as "variable displacement axial pumps with an oscillating plate".

If there is a plurality of pistons 10, the variable-inclination structure 41 contemporaneously regulates the travel of all the pumping pistons 10. In particular an end of each pumping piston 10 is constrained to the structure 41. The variable-inclination structure 41 enables displacing the pistons 10 with respect to the seatings 2 (the position of which is modified by the structure 41).

The regulating means 4 further comprise a fluid-dynamic actuator 42 for regulating the inclination of said structure 41. The fluid-dynamic actuator 42 is a piston.

A corresponding displacement of the pump 1 is associated to each inclination of the structure 41. If the "oscillating plate" is perpendicular to the shaft 3 the displacement would be zero. By increasing the inclination of the plate the displacement is also increased up to a maximum value.

The regulating means 4 comprise command means 43 of the actuator 42, as a function of an electrical signal (a predetermined electrical signal corresponds to each position of the actuator). The regulating means 4 assume at least a non-equilibrium configuration in which induce a displacement of said actuator 42 (see FIG. 3 or 5) and an equilibrium configuration in which they do not induce a movement of the actuator 42 (see FIG. 2 or 4).

The command means 43 in turn comprise a cursor 431 mobile at least between said equilibrium configuration and said non-equilibrium configuration; in this configuration of non-equilibrium the cursor 431 can assume at least a first position in which it places a chamber 420 acting on said actuator 42 in communication with a first zone 51 in which there is a pressure that is different from a pressure present in said chamber 420 (at least initially, while after establishing fluid communication the two pressures will tend to equilibrium).

The fluid-dynamic actuator 42 is associated at a first end to a variable-inclination structure 41. In the solution illustrated in FIG. 1, the actuator 42 is hinged to the first end of the variable-inclination structure 41. In other solutions that are not illustrated, between the fluid-dynamic actuator 42 and the variable-inclination structure 41 there is only one mechanical stop. In a second end the actuator 42 comprises a pusher surface which opens in the chamber 420.

With reference to FIG. 1, if the pressure in the chamber 420 increases, the structure 41 reduces its inclination, the travel of the pistons 10 diminishes and therefore the displacement also diminishes. If the pressure in the chamber 420 falls, the structure 41 increases its inclination (up to a maximum value), the travel of the pistons 10 increases and therefore the displacement also increases.

Figure 4:
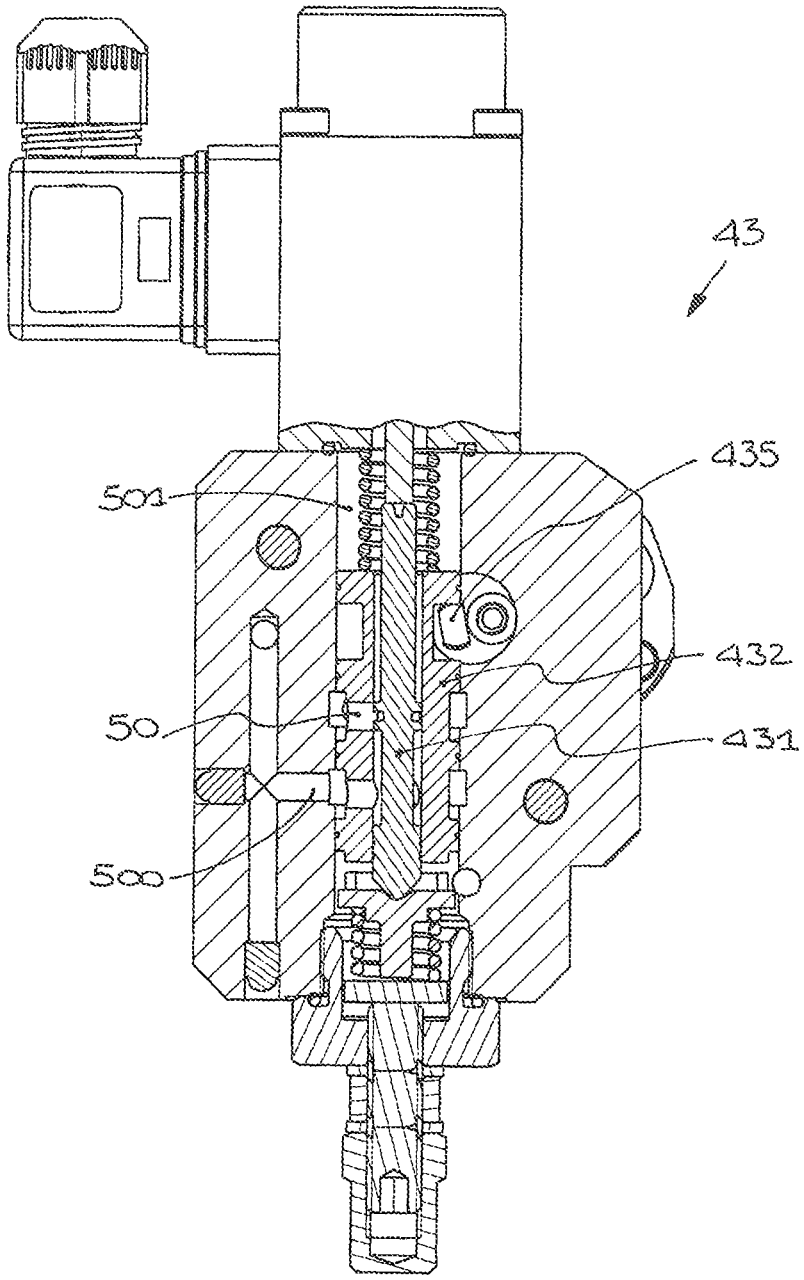

The command means 43 comprise a sliding element 432 with respect to the cursor 431 to reset the equilibrium configuration (see FIG. 4). The sliding element 432 is distinct from the actuator 42 and is mechanically actuated by a variation of an inclination of said structure 41.

In the first position the cursor 431 sets the chamber 420 in communication with the first zone 51 in which there is a pressure that at least initially can be lower than the pressure present in said chamber 420 (after the fluid communication has been established the two pressures tend to balance out). In this regard, see FIG. 3. In the non-equilibrium configuration the cursor 431 can assume a second position in which it places said chamber 420 in communication with a second zone 52 which at least initially can have a higher pressure with respect to a pressure in said chamber 420. The sliding element 432 comprises a jacket 433 of said cursor 431. The jacket 433 at least partly envelops the cursor 431. The jacket 433 can translate relative to the cursor 431. In the non-equilibrium configuration the fluid communication between the chamber 420 and the first zone 51 is achieved via a pathway comprising a gap 6 interposed between the jacket 433 and the cursor 431.

In the equilibrium configuration (see FIG. 2) the cursor 431 obstructs, at least partly, a first channel 50 in communication with said chamber 420 and which crosses a wall of the jacket 433. In fact in the equilibrium configuration the cursor 431 enables a minimum leakage of fluid from/towards the first and the second zone 51, 52.

The cursor 431 has a first groove 510 which in the first position is part of a pathway that places said first channel 50 in communication with the first zone 51 (in particular it places the first channel 50 in communication with a second channel 501). In this regard, see FIG. 3.

The cursor 431 has a second groove 520 which in the second position is part of a pathway that places said first channel 50 in communication with the second zone 52 (in particular it places the second channel 50 in communication with a third channel 500 which crosses the wall of the jacket 433). In this regard, see FIG. 5.

The jacket 433 is pre-tensioned by elastic means 7 which exert a force in a predetermined direction. In the illustrated example the elastic means 7 comprise a helical spring that can at least partly envelop the cursor 431.

The pump 1 comprises an element 410 solidly constrained to the variable-inclination structure 41 for inducing passage from the non-equilibrium configuration to the equilibrium configuration. The solidly constrained element 410 can therefore be defined as a reset organ of said equilibrium configuration.

The element 410 solidly constrained to the variable-inclination structure partly fits into a seating 434 fashioned on the jacket 433.

The element 410 solidly constrained to the variable-inclination structure 41 exerts a thrust in opposition to said elastic means 7 or alternatively enables displacement of the jacket 433 along said predetermined direction by the thrust exerted by the elastic means 7.

The variable-inclination structure 41 for enabling the variation of the displacement rotates about a regulating axis 411. The regulating axis 411 extends along a direction which is perpendicular to the rotation direction of the shaft 3 which activates the pistons 10. The axis 411 is advantageously fixed with respect to an external casing of the pump 1.

The element 410 solidly constrained to the variable-inclination structure 41 rotates about said regulating axis 411 and comprises an insert 435 which engages in the jacket 433 (internally of the seating 434) and which is offset with respect to said regulating axis 411.

In a constructional solution by way of example, the second zone 52 can be located downstream of said piston 10 along the outflow direction of said fluid. It is therefore at the pressure of the pump delivery (allowing for some load loss).

In an embodiment by way of example, the first zone 51 is in communication with an outside environment or upstream of said piston 10 along the outflow of said fluid or is in any case at a lower pressure than the pressure present in the second zone 52. It is preferably at atmospheric pressure or aspiration pressure. In more detail, the first zone 51, preferably coinciding with the pump body, where the drainage is collected, is in fluid communication with a tank for the fluid or is connected with the pump aspiration. The tank can be at atmospheric pressure or slightly pressurised.

In a particular constructional solution the pump 1 can comprise a pressure regulator 9. The regulator 9 can therefore define, in some operating conditions, the pressure of said second zone 52 and/or the pressure present in said chamber 420.

Figure 7:
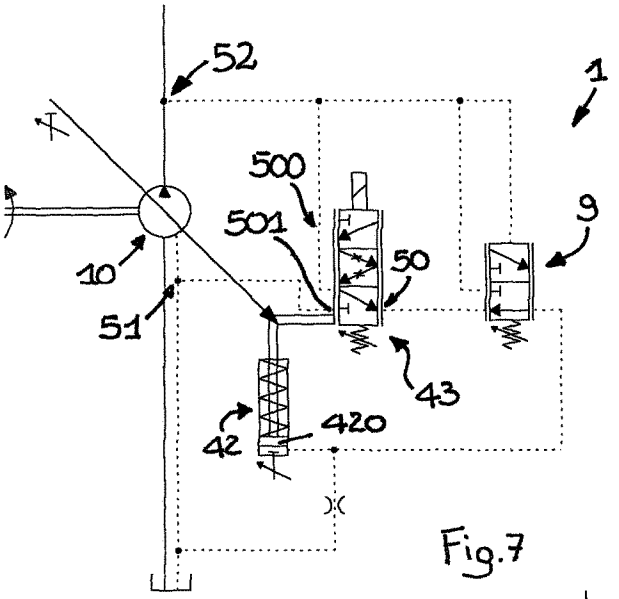

As shown by way of example in FIG. 7 the pressure regulator 9 is interposed between the chamber 420 and the command means 43.

Figure 9:
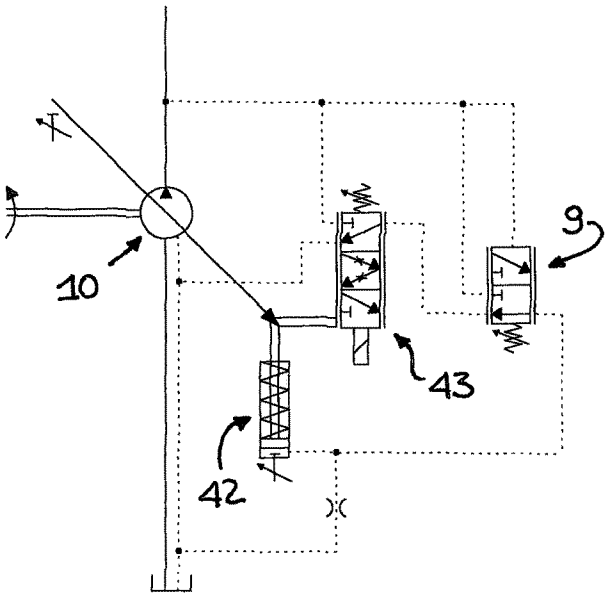
FIGS. 7, 8 and 9 show examples of fluid-dynamic circuits of variable displacement pumps according to the present invention.
Figure 8:
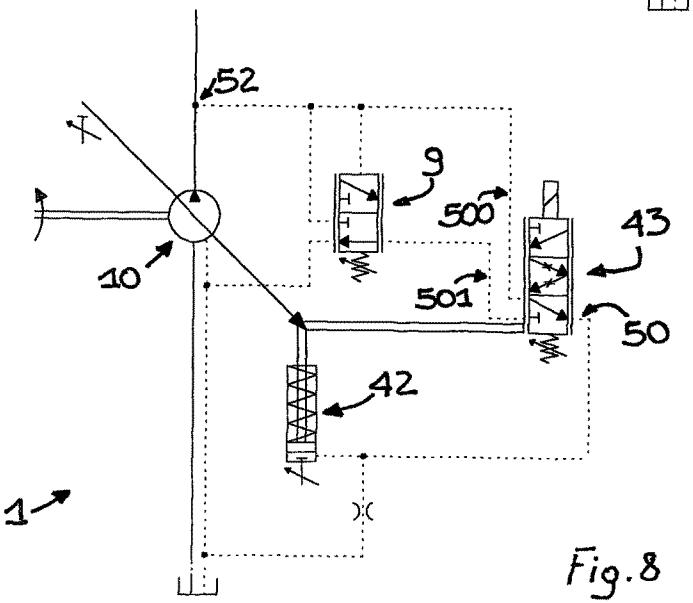

In the particular illustrative example of FIG. 8 (alternative to those of FIGS. 7 and 9), the second channel 501 is connected to the pressure regulator 9.

The command means 43 further comprise a proportional electromagnet 8 comprising a mover 80 of said cursor 431. This enables translating the electrical opening signal of the actuator 42 to be sent. The mover 80 is typically a pusher member.

The mover 80 is substantially coaxial with the cursor 431. The mover 80 moves along a translation direction of the jacket 433 with respect to the cursor 431.

The cursor 431 is subjected to contrasting forces exerted by said mover 80 and by an elastic retro-action. The mover 80 therefore exerts on the cursor 431 an opposed force from the elastic retro-action of a spring.

In a first constructional solution an increase of current in the electromagnet 8 determines an increase of displacement of the pump 1 (the direct version illustrated for example in FIGS. 2-5, 7 and 8). In a second constructional solution a reduction of current powering the electromagnet 8 determines an increase of displacement of the pump 1 (the indirect version illustrated for example in FIGS. 6 and 9).

The present invention also relates to a regulating method of an axial-piston pump having an oscillating plate. This pump 1 conveniently has one or more of the characteristics described hereinabove.

Figure 5:
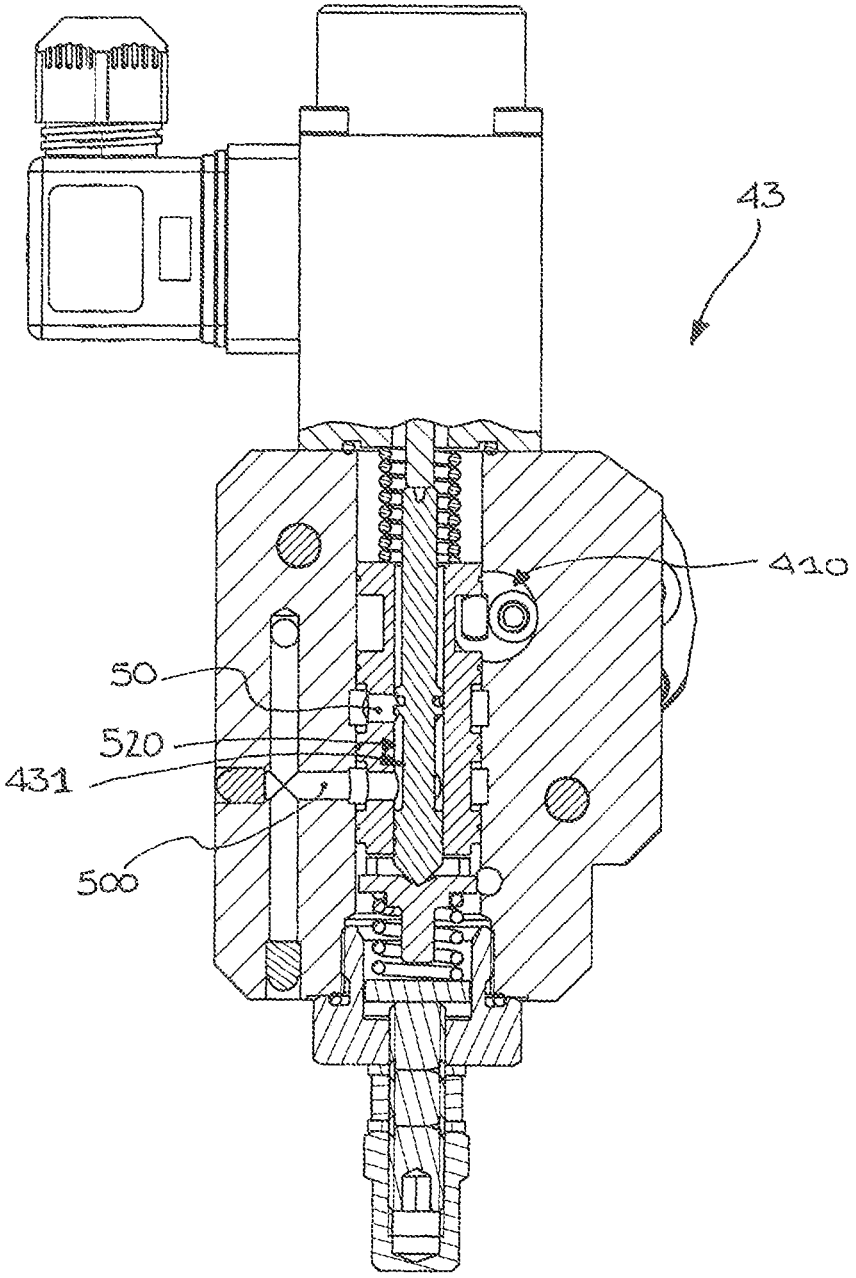
Figure 6:
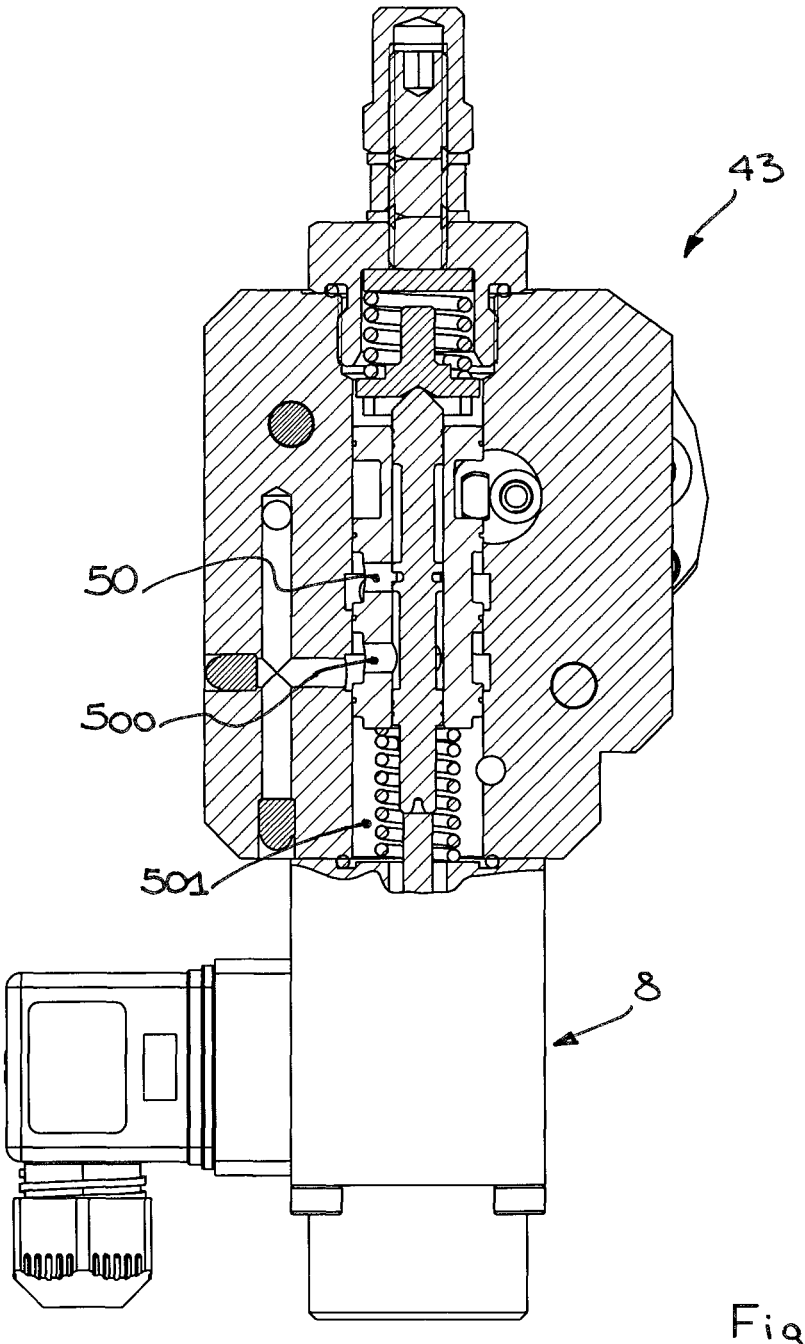
FIG. 6 is an alternative view of a component of a pump according to the present invention.

The method comprises the step of modifying the inclination of the oscillating plate 41 to which the pistons 10 are constrained. This step comprises the sub-step of intervening on the command means 43 of a fluid-dynamic actuator 42 for regulating the inclination of the oscillating plate 41. The command means 43 comprise a cursor 431 that is mobile internally of a jacket 433. The step of intervening on the command means 43 comprises the step of displacing the cursor 431 relatively to the jacket 433 so as to pass from an equilibrium configuration (FIG. 2) to a non-equilibrium configuration (FIG. 3). The step of displacing the cursor 431 is achieved by displacing a mover 80 having an electrically-activated rod (for example of a proportional electromagnet 8). The displacement of the mover 80 is done by modifying the electric supply to the proportional electromagnet 8. In the equilibrium configuration the cursor 431 obstructs a first channel 50 (see FIG. 2) that is in fluid communication with a thrust chamber 420 of the actuator 42. In passing from the equilibrium configuration to the non-equilibrium configuration, the thrust chamber 420 of the actuator 42 is set in fluid communication by means of said first channel 50 with a first zone 51 which at least at the outset is at a different pressure with respect to said thrust chamber 420 (FIG. 3) or with a second zone 52 which at least initially is at a different pressure with respect to said thrust chamber 420 (FIG. 5). This causes a change in pressure in the thrust chamber 420 and therefore a displacement of the actuator 42 which in turn moves the oscillating plate 41 (the actuator 42 in the preferred solution develops between the thrust chamber 420 and an opposite end to which the plate 41 is associated). In passing from the equilibrium configuration to the non-equilibrium configuration the cursor 431 de-obstructs the first channel 50.

In passing from the equilibrium configuration to the non-equilibrium configuration, the thrust chamber 420 of the actuator 42, as a function of the displacement direction of the cursor 431, is set in fluid communication by means of said first channel 50 with two distinct zones. Initially these zones respectively have a higher pressure and a lower pressure than said thrust chamber 420. In this way the displacement of the oscillating plate 41 can be regulated in one direction or the other, to which an increase or decrease in the displacement of the pump respectively corresponds.

The method also comprises a step of modifying the position of said jacket 433 (see FIG. 4) for enabling resetting of said equilibrium configuration (see FIG. 5); the step of modifying the inclination of the oscillating plate 41 comprising a step of displacing an abutment 410 solidly constrained to said plate 41 and located in abutment with said jacket 433, thus enabling a displacement of the jacket 433. In fact the step of displacing the abutment 410 solidly constrained to the plate alternatively determines (as a function of the direction in which the inclination of the plate 41 is modified):

i) a displacement of the jacket 433 against the force exerted by pre-tensioned elastic means 7 acting on the jacket;

ii) a displacement of the jacket 433 along the same direction as the force exerted by the elastic means 7.

Figure 2:
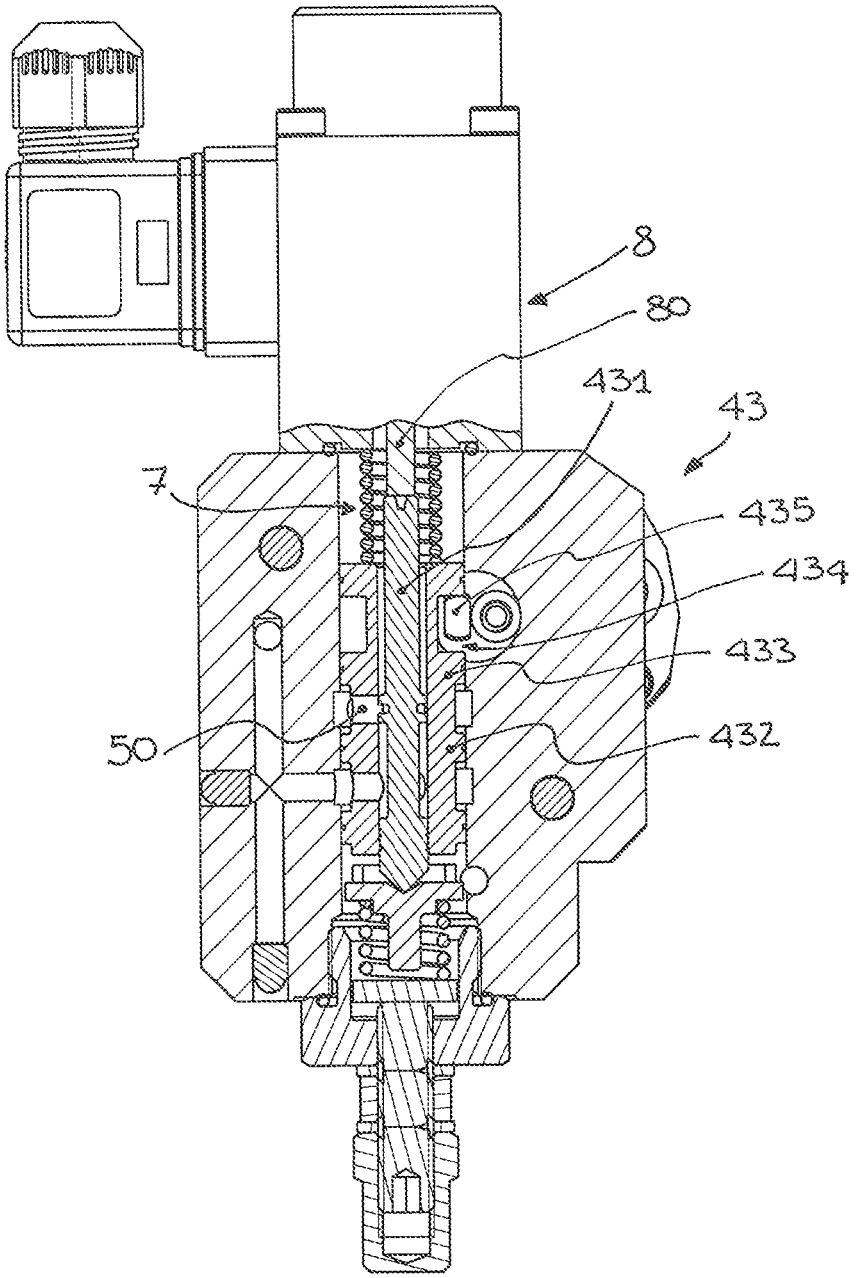
FIGS. 2-5 show successive steps of the operation of the pump according to the present invention.
Figure 3:
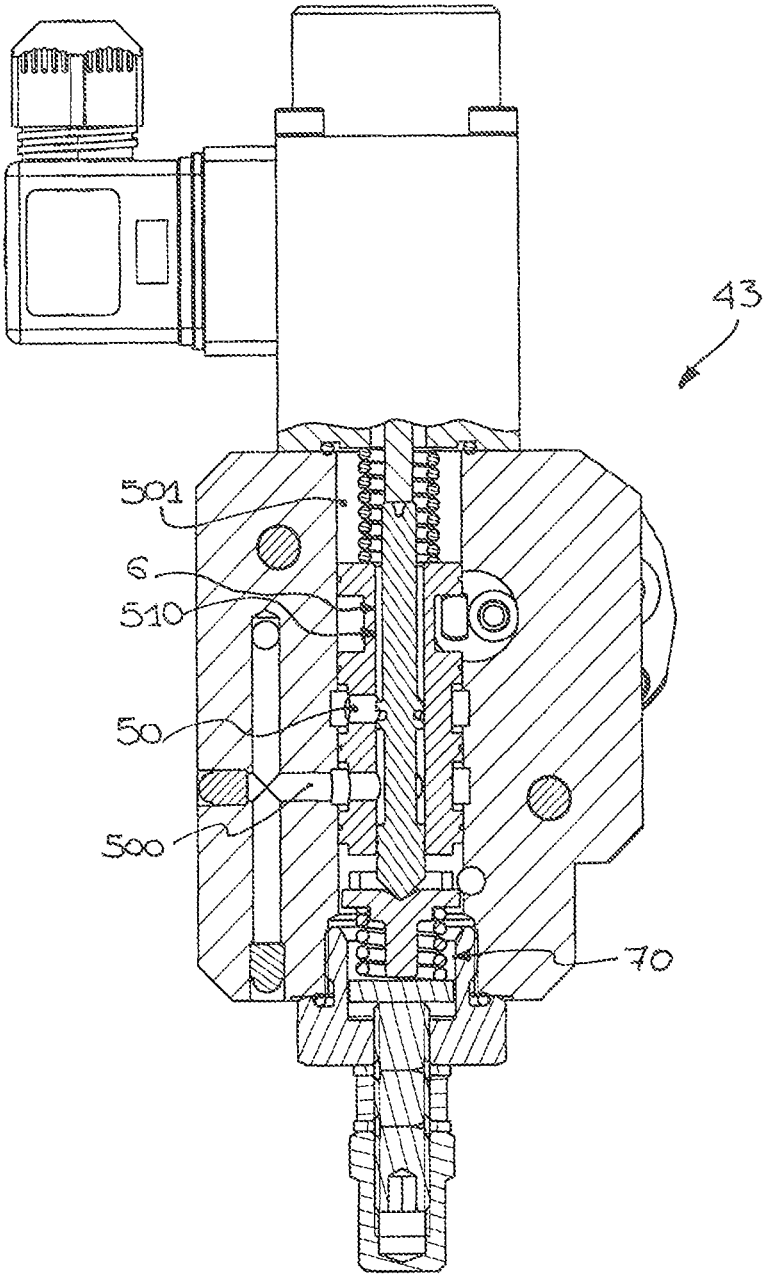

With explicit reference to FIGS. 2-5 the operation of the invention can be summed up as follows:

FIG. 2: the cursor 431 at least partly obstructs the first channel 50 connected to the chamber 420; the pressure in the first channel 50 is intermediate to the pressure present in the second and third channel 501, 500;

FIG. 3: if the command in terms of current increases, the proportional electromagnet exerts a greater force so that the cursor 431 compresses a regulating spring 70 and displaces downwards; consequently the cursor 431 opens the connection between the first channel 50 and the second channel 501, keeping the connection between the first channel 50 and the third channel 500 closed. In this way the pressure in the first channel 50 decreases and the displacement of the pump 1 increases;

FIG. 4: starting from FIG. 3, when the displacement increases, the element 410 solidly constrained to the oscillating plate 41 displaces downwards. The jacket 433 maintained in abutment on the element 410 by the elastic means 7 also displaces downwards up to newly moving into the equilibrium position; the cursor 431 therefore obstructs the first channel 50 of the jacket 433; there will be a new equilibrium configuration in which in the presence of a command current greater than the proportional electromagnet 8 there will be a greater displacement;

FIG. 5: if the current command in the proportional electromagnet 8 drops, that will exert a smaller force, so the cursor 431, by compressing the regulating spring 70 less, displaces upwards. The cursor 431 keeps the connection between the first and the second channel 50, 501 closed and opens the connection between the first and the third channel 50, 500. In this way the pressure in the first channel 50 increases and the displacement of the pump decreases. Consequently the element 410 will displace upwards and the jacket 433 will follow it up to moving into a new equilibrium configuration (not illustrated).

The present invention offers many advantages.

Primarily it enables providing a stable device that is not subject to particular oscillations. This is thanks to the mechanical connection between the oscillating plate and the jacket (avoiding interposing of springs or like elements). Further, it enables optimising the components of the pump, avoiding the presence of:

a sensor for detecting the angular position of the plate; and a control in a closed loop requiring a suitable setting for guaranteeing stability (absence of oscillations).

The invention as it is conceived is susceptible to numerous modifications and variants, all falling within the scope of the inventive concept by which it is characterised. Further, all the details can be replaced with other technically-equivalent elements. In practice, all the materials used, as well as the dimensions, can be any according to requirements.

The invention claimed is:

1. A variable displacement pump comprising:

i) a pumping piston (10) of a fluid to be treated;

ii) a sliding seating (2) along which a travel of the piston (10) takes place;

iii) a rotating shaft (3) which draws both said piston (10) and said seating (2) in rotation, a rotation of said shaft (3), at least in an operating configuration, corresponding to a sliding of the piston (10) along the seating (2);

iv) regulating means (4) of the displacement of the pump (1) as a function of an electrical signal, said regulating means (4) in turn comprising:

a structure (41) having a variable inclination for regulating a length of a travel of the pumping piston (10) and therefore of a displacement of the pump (1); said variable-inclination structure (41) constraining an end of the piston (10);

a fluid-dynamic actuator (42) for regulating an inclination of said structure (41), a corresponding displacement of the pump (1) being associated to each inclination of the structure (41);

command means (43) of the actuator (42), which assume at least a non-equilibrium configuration in which the command means (43) induce a displacement of said actuator (42) and an equilibrium configuration in which the command means (43) do not induce a movement of the actuator (42), said command means (43) in turn comprising:

(a) a cursor (431) mobile at least between said equilibrium configuration and said non-equilibrium configuration, the cursor (431) in said non-equilibrium configuration being able to take at least a first position in which it places a chamber (420) acting on said actuator (42) in communication with a first zone (51) at least initially having a pressure that is different from a pressure present in said chamber (420);

(b) a sliding element (432) with respect to the cursor (431) for resetting said equilibrium configuration, said sliding element (432) being distinct from said actuator (42) and being mechanically actuated in consequence of a variation of an inclination of said structure (41);

the sliding element (432) comprising a jacket (433) of said cursor (431); said jacket (433) being pre-tensioned by elastic means (7) which exert a force in a predetermined direction;

said pump (1) comprising an element (410) solidly constrained to the variable-inclination structure (41) for inducing passage from the non-equilibrium configuration to the equilibrium configuration; said element (410) solidly constrained to the variable-inclination structure (41) exerting a thrust in opposition to said elastic means (7) or alternatively enabling displacement of the jacket (433) along said predetermined direction.

2. The pump according to claim 1, characterised in that in said non-equilibrium configuration the cursor (431) can take a second position in which it places said chamber (420) in communication with a second zone (52) which can have a different pressure with respect to a pressure present in the first zone (51) and which at least initially has a different pressure with respect to a pressure in said chamber (420).

3. The pump according to claim 2, characterised in that:

said second zone (52) is downstream of said piston (10) along an outflow direction of said fluid;

said first zone (51) is in communication with an outside environment or upstream of said piston (10) along a flow of said fluid or is at a lower pressure than a pressure present in the second zone (52).

4. The pump according to claim 1, characterised in that in said non-equilibrium configuration the fluid communication between said chamber (420) and said first zone (51) is achieved via a pathway comprising a gap (6) interposed between the jacket (433) and the cursor (431).

5. The pump according to claim 1, characterised in that the variable-inclination structure (41) for enabling the variation of the displacement rotates about a regulating axis (411); said element (410) solidly constrained to the variable-inclination structure partially engaging in a seating (434) fashioned on the jacket (433).

6. The pump according to claim 5, characterised in that said element (410) solidly constrained to the variable-inclination structure (41) rotates about said regulating axis (411) and comprises an insert (435) which engages in the jacket (433) and which is offset with respect to said regulating axis (411).

7. The pump according to claim 2, characterised in that in the equilibrium configuration the cursor (431) obstructs at least partly a first channel (50) in communication with said chamber (420) and which crosses a wall of the jacket (433);

the cursor (431) having a first groove (510) which in the first position is part of a pathway that places said first channel (50) in communication with the first zone (51);

the cursor (431) having a second groove (520) which in the second position is part of a pathway that places said first channel (50) in communication with the second zone (52).

8. The pump according to claim 1, characterised in that the command means (43) further comprise a proportional electromagnet (8) comprising a mover of said cursor (431).

9. A regulating method of an axial-piston pump having an oscillating plate, comprising the steps of:

i) modifying an inclination of the oscillating plate (41) to which pistons (10) are constrained, said step comprising a sub-step of operating command means (43) of a fluid-dynamic actuator regulating an inclination of the oscillating plate (41), said command means (43) comprising: a cursor (431) mobile internally of a jacket (433); the step of operating the command means (43) comprising a step of displacing the cursor (431) relatively to the jacket (433) in order to pass from an equilibrium configuration to a non-equilibrium configuration; the cursor (431) in the equilibrium configuration obstructing a first channel (50) which is in fluid communication with a thrust chamber (420) of the actuator (42); in passing from the equilibrium configuration to the non-equilibrium configuration the thrust chamber (420) of the actuator (42) being placed in fluid communication via said channel (50) with a first zone (51) which at least initially is at a different pressure with respect to said thrust chamber (420);

ii) modifying the position of said jacket (433) for enabling resetting of said equilibrium configuration;

the step of modifying the inclination of the oscillating plate (41) comprising a step of displacing an abutment (410) solidly constrained to said plate (41) and located in abutment with said jacket (433), thus enabling a displacement of the jacket (433).

* * * * *